United States Patent [19]

Teder et al.

[11] Patent Number: 4,637,102

[45] Date of Patent: Jan. 20, 1987

[54] SAFETY BELT BUCKLE FOR VEHICLES

[75] Inventors: Leonid O. Teder; Tiit A. Org; Vaino G. Lauri; Ants J. Aas, all of Tallin, U.S.S.R.

[73] Assignee: Proizvodstvennoe Obiedinenie "Norma", U.S.S.R.

[21] Appl. No.: 763,136

[22] PCT Filed: Sep. 13, 1984

[86] PCT No.: PCT/SU84/00050

§ 371 Date: May 22, 1985

§ 102(e) Date: May 22, 1985

[87] PCT Pub. No.: WO85/01483

PCT Pub. Date: Apr. 11, 1985

[30] Foreign Application Priority Data

Oct. 3, 1983 [SU] U.S.S.R. ..... 3649101
Oct. 2, 1984 [FR] France ..... 84 15128

[51] Int. Cl.[4] ..... A44B 11/14

[52] U.S. Cl. ..... 24/642; 24/635; 24/645

[58] Field of Search ..... 24/642, 643, 644, 645, 24/646, 647, 648, 649, 650, 635, 636, 637, 638, 24/639, 640, 641

[56] References Cited

U.S. PATENT DOCUMENTS

| | | | |
|---|---|---|---|
| 2,941,272 | 6/1960 | Bourguignon . | |
| 3,623,194 | 11/1971 | Claeson et al. | 24/639 |
| 3,713,192 | 1/1973 | Wallin | 24/645 |
| 4,084,298 | 4/1978 | Fohl | 24/642 |
| 4,094,046 | 6/1978 | Takada | 24/642 |
| 4,096,606 | 6/1978 | Stephenson | 24/641 |
| 4,100,657 | 7/1978 | Minolla | 24/642 |
| 4,334,341 | 6/1982 | Krautz et al. | 24/635 |

FOREIGN PATENT DOCUMENTS

| | | | |
|---|---|---|---|
| 2160089 | 6/1972 | Fed. Rep. of Germany | 24/642 |
| 2915246 | 10/1979 | Fed. Rep. of Germany | 24/635 |
| 188031 | 10/1922 | United Kingdom | 24/647 |
| 1603132 | 11/1981 | United Kingdom . | |

*Primary Examiner*—Victor N. Sakran
*Attorney, Agent, or Firm*—Steinberg & Raskin

[57] ABSTRACT

A safety belt buckle comprises a latch portion including two parallel plates, locking elements in the form of rolls, members for stopping the rolls in latched and unlatched positions of the buckle in the form of a wedge and plate-like pushers respectively, a member for unlatching the buckle fashioned as a button, and a catch part in the form of a prong having a slot for receiving the safety belt and a portion insertable into the shell. The plates of the shell have slots for the rolls to move therein and slots wherethrough the wedge is connected to the button.

16 Claims, 5 Drawing Figures

SAFETY BELT BUCKLE FOR VEHICLES

FIELD OF THE INVENTION

This invention relates generally to passive safety systems of vehicles, and more particularly to a construction of locks or buckles for vehicle safety belts.

The safety belt buckle according to the invention can be used most successfully for protecting vehicle drivers and passengers from road accidents by supporting the weight of wearers under impacts.

The proposed buckle can also be used with other types of safety belts employed, for example, in aviation, by steeplejacks, and elsewhere.

BACKGROUND ART

Rule 16 of the ECE UN International Regulations prescribes very stringent requirements to be met by vehicle safety belts locks. Particularly, the lock must withstand a load of over 1500 kgf and function satisfactorily; it should further withstand no less than 5000 latch-unlatch cycles without its strength being affected; both lock parts, male and female, must interlock automatically without intermediate steps of incomplete latching; the minimal pressure force exertable on the release button for unlatching the lock under a 30.6 kgf load must not exceed 6.1 kgf, etc.

There is known a safety belt lock or buckle for vehicles comprising two interlatching parts, particularly a female part and a male part. The female part includes a bar attachable to the vehicle body, and a shell secured in a protective housing, connected to the bar and made up of two parallel power plates. The female part also comprises locking elements movably arranged in the shell and fashioned as rolls, spring-biased members for stopping the rolls in the latched and unlatched positions of the buckle, and a member for unlatching the buckle in the form of a pressure button slidable along the shell.

The male part of the buckle has the form of a prong with an eye or slot for receiving the safety belt, this prong having a flat portion insertable into the shell and having at its end symmetrical shaped projections for engagement with the rolls in the shell (cf., e.g., Laid-Open Application of West Germany No. 2,915,246; Cl. A 44 B 11/14).

In the aforedescribed prior art safety belt buckle the power plates of the shell are provided with slots for the rolls to movably accommodate therein and recesses for the locking means in the form of balls. The member for stopping the rolls in latched position of the buckle is mounted on the shell and fashioned as a spring-loaded ring element embracing the shell and having inner recesses for the rolls and balls.

In the known technical solution, for rendering the buckle reliable under heavy loads, including those tending to twist the shell, the member for stopping the rolls in the form of a ring embracing the shell must be sufficiently strong, and therefore this ring is fabricated from metal to offer greater toughness. However, the provision of high-precision recesses for receiving the rolls and balls is associated with certain manufacturing difficulties. On the other hand, the heavy bulk of the buckle necessitates its locking by balls, which makes the overall construction complicated.

In addition, because the ring is capable of movement relative to the entire cross-section of the shell, the protective housing of the buckle also becomes overcomplicated, since accidental jamming of the ring between the shell and the housing during buckle use must be prevented. Further, the aforedisclosed technical solution calls for increase in the cross-sectional dimensions of the buckle.

SUMMARY OF THE INVENTION

This invention is directed toward the provision of a safety belt buckle for vehicles having such structural arrangement of a shell and means for stopping rollers in latched and unlatched positions of the buckle as to improve the reliability of the buckle and simplify its construction.

The aims of the invention are attained by that in a safety belt buckle for vehicles comprising two interlocking parts, particularly a latch part which includes a shell made up of two parallel power plates disposed inside a housing and connected to a bar attachable to a vehicle body, locking elements in the form of rolls movably arranged in the shell, spring-biased members for stopping the rolls in latched and unlatched positions of the buckle, and means for unlatching the buckle in the form of a push button slidable along the shell, as well as a catch part in the form of a prong having a slot to receive the belt and further having a flat portion insertable into the shell and provided at its end with symmetrical lugs engageable with the rolls, according to the invention, provided in the plates transversely of the central axis of the shell are mutually coaxial shaped slots adapted to receive the rolls, whereas arranged in line with the central axis of the shell are mutually coaxial slots, the member for stopping the rolls in the latched position of the buckle having the form of a wedge rigidly connected through the slots made in the plates of the shell to the push button and having a tapered end facing the rolls, the member for stopping the rolls in unlatched position of the buckle having the form of plate-like pushers secured edgewise of the plates of the shell for engagement with the end face of the portion of the prong insertable into the shell and with the rolls, the lugs of the insertable portion of the prong being defined by a shaped recess open on its end to face each other.

Thanks to the aforedescribed arrangement, the rolls are stopped in the latched position of the buckle by forcing the wedge between the rolls and by means of the shaped recess provided in the insertable portion of the prong to embrace the rolls, whereby the use of a massive ring embracing the shell becomes unnecessary. This in turn considerably simplifies the device structurally and makes the parts of the buckle easier to fabricate. At the same time, the overall dimensions of the buckle are reduced accompanied by an improvement in its reliability, because accidental jamming of the wedge is practically impossible.

Preferably, the front ends of the shell plates are bonded together by a rivet, whereas the shaped recess of the insertable portion of the prong has an indentation adapted to embrace the inner portion of the rivet in the latched position of the buckle.

The above arrangement improves the reliability of the buckle, since twisting forces exerted on the latched buckle fail to cause damage of the buckle and are not transmitted to the buckle housing enclosing the shell.

Advisably, the width of the clearance between the lugs of the insertable portion of the prong is equal to the sum of the diameters of the rolls, whereas the width of the inner portion of the shaped recess preferably equals the sum of diameters of the rolls and the width of the wedge.

This renders a greater strength to the buckle and ensures that the parts of the buckle operate more accurately, since the clearances between the rolls and the working surfaces of the recess in the insertable portion of the prong and wedge are substantially reduced.

Further, it is advantageous to make the shaped slots in the power plates of the shell arcuate. In case of such an arrangement, optimized distribution of loads exertable on the buckle elements is attained to ensure that the prescribed minimum of pressure force required for actuating the button for unlatching the buckle under tensile loads is guaranteed.

For more accurate guiding of the portion of the prong insertable into the shell, the housing is provided in its interior with elongated ribs confining the shell on two sides in terms of width of the insertable portion of the prong. As is obvious from the foregoing, the arrangement just described does not affect the strength of the housing normally fabricated from a plastic material, since high twisting loads exertable on the buckle are countered by the shell thanks to the provision of the rivet connecting the front ends of its power plates and the indentation made in the shaped recess of the insertable portion of the prong and embracing the rivet.

BRIEF DESCRIPTION OF THE DRAWINGS

The invention will now be described in greater detail with reference to a preferred embodiment thereof taken in conjunction with the accompanying drawings, in which.

BEST MODE OF CARRYING OUT THE INVENTION

Figure 1:
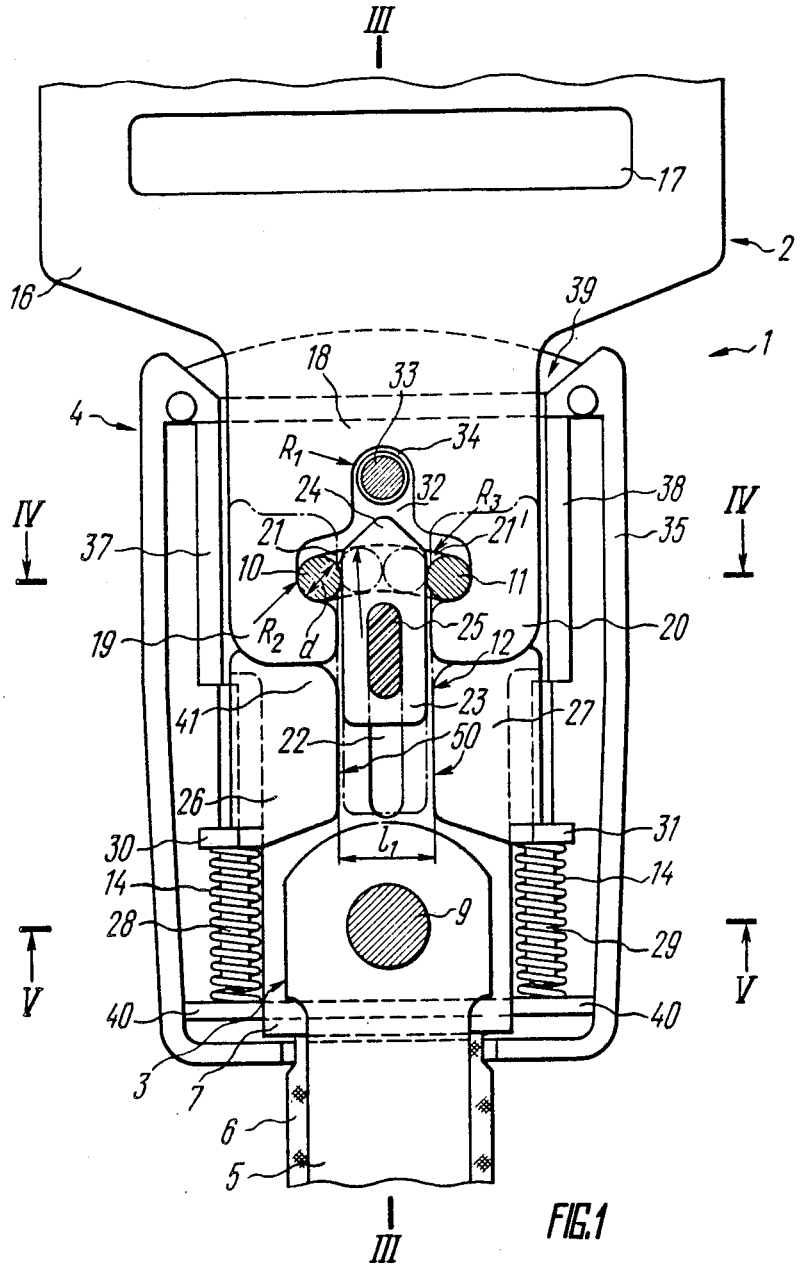
FIG. 1 is a plan view of a safety belt buckle according to the invention in latched position with the front half of the housing removed, a press button for unlatching the buckle and one of the power plates of the shell not being shown.
Figure 2:
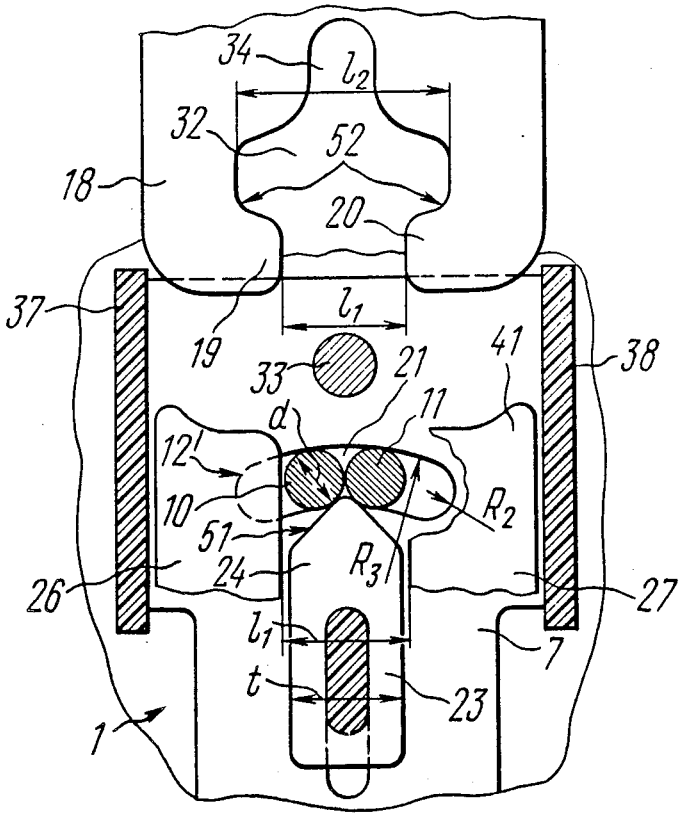
FIG. 2 illustrates a portion of the buckle of FIG. 1 in unlatched position.

The proposed safety seat belt buckle for vehicles illustrated in FIGS. 1 and 2 comprises two parts indicated in FIG. 1 by 1 and 2, respectively, which can be latched to each other when they are brought together, these two parts being referred to hereinafter as latch part 1 and catch part 2.

The latch part 1 includes a shell 3 disposed inside a housing 4 to be connected to a bar 5 having a protective-decorative plastic coating 6 applied thereto and secured to a vehicle body (not shown).

Figure 3:
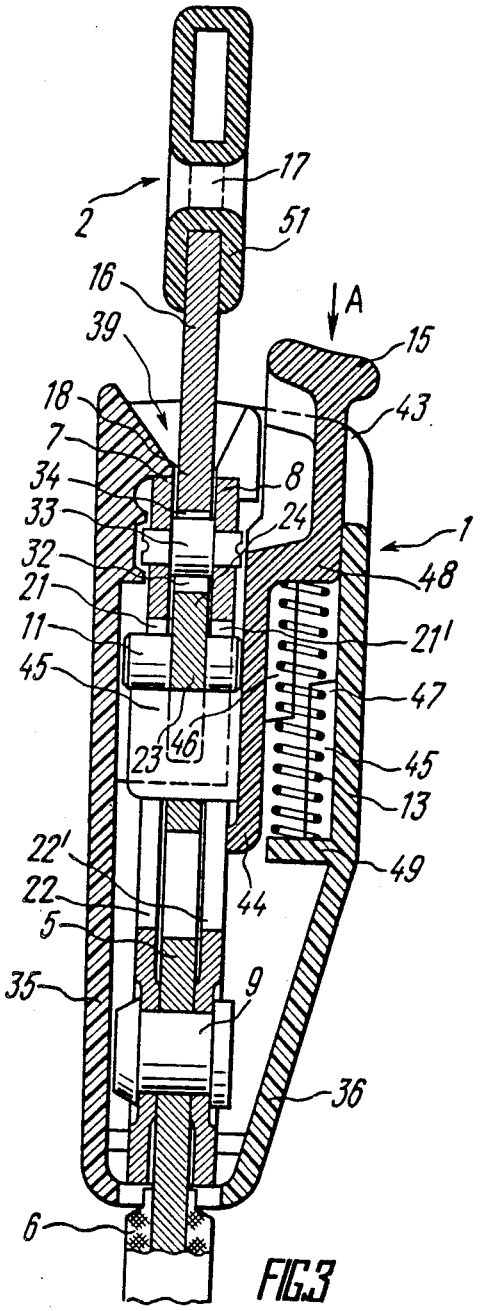
FIG. 3 is a section taken along the line III—III in FIG. 1.

The shell 3 comprises two parallel power plates 7 (FIG. 3) and 8 clamped together at their end portions by a rivet 9.

Figure 4:
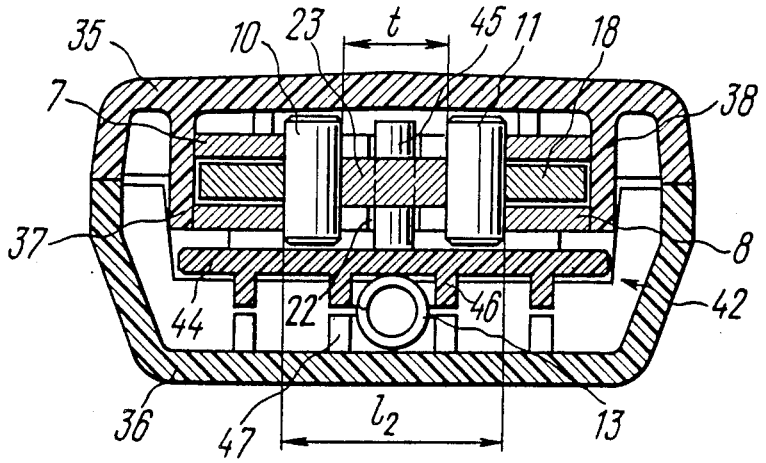
FIG. 4 is a section taken along the line IV—IV in FIG. 1.
Figure 5:
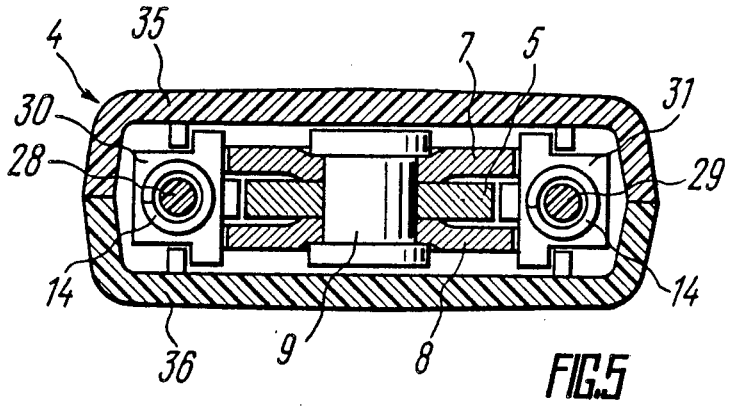
FIG. 5 is a section taken along the line V—V in FIG. 1.

The latch part 1 of the buckle also includes locking elements in the form of rolls 10 (FIG. 1) and 11 movably secured in the shell 3, a member 12 for stopping the rolls 10 and 11 in latched position of the buckle and a member 12′ (FIG. 2) for stopping the rolls 10 and 11 in unlatched position of the buckle, these members 12 and 12′ being mounted on springs 13 (FIG. 4) and 14 (FIG. 5), respectively, as well as a means for unlatching the buckle in the form of a press button 15 (FIG. 3) slidable along the central axis of the shell 3.

The catch part 2 of the buckle is fashioned as a prong 16 (FIG. 1) having a slot 17 to receive the safety belt (not shown) and having a substantially flat portion 18 insertable into the shell 3 and provided at its end with symmetrically arranged lugs 19 and 20 for engagement with the rolls 10 and 11 and with the power plates 7 and 8.

According to one feature of the invention, provided centrally of the front portion of each of the plates 7 and 8 are shaped slots 21 and 21′ for receiving the rolls 10 and 11. These slots 21 (FIG. 2) and 21′ are coaxial and run transversely of the central axis of the shell 3. In addition, the power plates 7 and 8 have coaxial slots 22 and 22′ arranged in line with the central axis of the shell 3.

The member 12 for stopping the rolls 10 and 11 in a locked position of the buckle is fashioned as a substantially flat wedge 23 (FIG. 1) rigidly connected to the press button 15 through the slots 22 and 22′ in the power plates 7 and 8. The rigid connection of the wedge 23 with the button 15 is made possible thanks to a projection (not shown) provided on the button 15. The working portion of the wedge 23 has an end 24 tapering toward the rolls 10 and 11, whereas the central portion of the flat wedge 23 has an elongated hole 25. Side faces of the wedge 23 may be either parallel or may taper slightly toward the working portion thereof.

The member 12′ (FIG. 2) for stopping the rolls 10 and 11 in unlocked position of the buckle has the form of plate-like pushing elements 26 and 27 arranged at the sides of the power plates 7 and 8 of the shell 3 and engageable with the end face of the portion 18 of the prong 16 insertable into the shell 3 and with the rolls 10 and 11. These pushers 26 and 27 have tail pieces 28 (FIG. 5) and 29 having projections 30 and 31, respectively, which carry springs 14 with ends thereof thrusting against the projections 30 and 31.

The lugs 19 and 20 on the portion 18 of the prong 16 insertable into the shell 3 are defined by a shaped recess 32 (FIG. 1) open on the end of this portion 18, these lugs 19 and 20 are opposite to each other and spaced from each other at a distance $l_1$ inside the recess 32. The lugs 19 and 20 have smoothly rounded angles.

The front ends of the power plates 7 and 8 are joined together by a spaced rivet 33, whereas in order to embrace its inner part in the locked position of the buckle, there is provided an indentation 34 in the shaped recess 32, this indentation having an inner locking radius $R_1$ corresponding to the curvature radius of the inner part of the rivet 33.

The distance $l_1$ between the lugs 19 and 20 of the insertable portion 18 of the prong 16 equals to the sum of diameters d of rolls 10 and 11, whereas the width $l_2$ of the inner section of the shaped recess 32 equals to the sum of diameters d of the rolls 10 and 11 and the width t of the wedge 23.

The shaped slots 21 and 21′ provided in the plates 7 and 8 of the shell 3 are arcuate. The lugs 19 and 20 on the insertable portion 18 of the prong 16 mates with the wider portion of the shaped recess 32 through a curvature having a radius $R_2$ equal to the curvature radii of the rolls 10 and 11.

The shell is enclosed by a plastic housing 4 made up of a rear section 35 (FIG. 4) and a front section 36 joined together such as by ultrasonic welding. The rear section or half 35 of the housing 4 has longitudinally extending ribs 37 and 38 confining the front or latch part of the shell 3 on both sides and functioning as guide walls for accurately receiving the insertable portion 18 of the prong 16 into the space between the power plates 7 and 8 of the shell 3. An inlet hole 39 (FIG. 3) flaring outwardly is provided on the end face of the latch part l of the bucket to facilitate the reception of the prong 16 by the shell 3.

The slots 21 and 21' are rounded at their ends at a radius $R_2$ corresponding to the curvature radii of the rolls 10 and 11, a radius $R_3$ of the curvature of the arches of the slots 21 and 21' being preferably within three to seven times the diameter d of the rolls 10, 11. The width of the slots 21 and 21' is comparable with the diameter d of the rolls 10, 11, although a small clearance is preferably provided to ensure that these rolls 10 and 11 could freely move to remain perpendicular to the planes of the power plates 7 and 8.

The other ends of the springs 14 bear on shelves 40 made inside the rear half 35 of the housing 4. Ends 41 of the plate-like pushers 26 and 27 have shaped configuration to cooperate with the rolls 10 and 11 and with the end face of the prong 16. Provided between the front half 36 of the housing 4 and shell 3 is a cavity 42 (FIG. 4) in which there is mounted unlatching means or push button 15 partially extending through a port 43 (FIG. 3) made in the front half 36 of the housing 4. Wall 44 of the button 15 adjoins the shell 3 and has provided thereon a lug 45 extending through the slots 22 and 22' in the plates 7 and 8 and through the elongated hole 25 in the wedge 23. In this manner the push button 15 is rigidly connected to the wedge 23. In a space between the wall 44 of the button 15 and the front half 36 of the housing 4 the spring 13 (FIGS. 3 and 4) is disposed to be confined between longitudinally extending ribs 46 and 47 provided partially on the wall 44 and partially inside the front half 36 of the housing 4. The spring 13 bears by one of its end on a cross rib 48 of the button 15 and by the other end on a shelf 49 provided in the interior of the front half 36 of the housing 4. The distance between inner side edges 50 of the plate-like pushers 26 and 27 is accordingly $l_1$ to correspond to the sum of diameters d of the rolls 10 and 11.

The outer part of the prong 16 is coated with a plastic layer 51 (FIG. 3), this being necessary to prevent damage to a safety belt (not shown) when it is passed through the slot 17 thereby protecting the safety belt from sharp edges of the metal of the prong 16.

The proposed safety belt buckle operates in the following manner.

When unlocked, the plate-like pushers 26 and 27 (FIG. 2) rest in their extreme projected position to hold by their inner side edges 50 the rollers 10 and 11 in the central portion of the slots 21 and 21', whereas the wedge 23 is pressed by its tapered end 24 against the two rolls 10 and 11. Therewith, the push button 15 occupies its extreme depressed position for its spring 13 to be fully compressed.

During latching, the insertable portion 18 of the prong 16 enters the shell 3, and its end faces are brought into contact with the respective end faces 41 of the plate-like pushers 26 and 27. A further travel of the portion 18 insertable inside the shell 3 is guided by the ribs 37 and 38 of the rear half 35 of the housing 4, whereby the springs 14 of the pushers 26 and 27 are compressed.

At the point when the rolls 10 and 11 pass through the lugs 19 and 20 of the portion 18 of the prong 16 the distance $l_1$ between which, as has been stated above, corresponds to the sum of diameters d of the rolls 10 and 11, the tapered end 24 of the working portion of the wedge 23 acts by its tapers 51 and the spring 13 to push the rolls 10 and 11 apart to their extreme positions in the slots 21 and 21' of the power plates 7 and 8. Therefore, the rolls 10 and 11 tend to occupy corners 52 of the shaped recess 32 in the insertable portion 18, whereas the wedge 23 travels further forward to lock the rolls 10 and 11. In consequence, the push button 15 is drawn in a direction opposite to one indicated by the arrow A in FIG. 3 to occupy its extreme raised position. Also, in the course of latching, the indentation 34 of the recess 32 of the insertable portion of the prong 16 tends to embrace the mid-portion of the spaced rivet 33 (FIG. 1). One advantage of this action resides in that the prong 16 is held securely in the shell 3 against twisting loads in a plane parallel with the power plates 7 and 8, whereby the ribs 37 and 38 confining the sides of the shell 3 are not subjected to excessive loads. In the thus latched position the safety belt buckle according to the invention is capable of withstanding high tensile loads and is not susceptible to various lateral impacts.

In order to unlatch the buckle, it is necessary to apply a force of pressure to the push button 15 as indicated by the arrow A to thereby compress the spring 13. In consequence, the lug 45 on the wall 44 of the push button 15 acts on the wedge 23 to shift it from the position it occupies between the rolls 10 and 11.

When the working portion of the wedge 23 retracts completely, the lugs 19 and 20 having rounded corners 52, act by the pressure produced by the springs 14 of the plate-like pushers 26 and 27 to move the rolls 10 and 11 about the upper arc of the radius $R_3$ of the slots 21 and 21' until they are drawn together in the central portion of these slots. The pushers 26 and 27 then eject the thus released prong 16 from the shell 3. Concurrently, while cooperating by the ends 41 and side walls 50 with the rolls 10 and 11, the plate-like pushers 26 and 27 project to their upmost position to stop the rolls 10 and 11 in the unlatched position of the buckle.

INDUSTRIAL APPLICABILITY

The safety belt buckle embodying the present invention features high reliability and extended service life, which ensures passive vehicle safety for the driver and other wearers of safety belts using the proposed buckle.

The safety belt buckle is sufficiently small in size and easy to construct. Mass production of the proposed buckle is amenable to mechanization and automation.

In view of the foregoing, the proposed buckle is less costly to fabricate than most prior art constructions of fastening devices used in vehicle safety belts.

What is claimed is:

1. A safety belt buckle for vehicles, comprising two interlocking parts, a latch part and a catch part, said latch part including a shell formed by two substantially parallel plates disposed inside a housing and connected to a bar secured to a vehicle body, locking elements in the form of rolls movably disposed in said shell, spring-biased members for stopping said rolls in both latched and unlatched positions of the buckle, and a member for unlatching the buckle in the form of a push-button and being slidable along said shell, said catch part in the form of a prong having a slot to receive the belt and additionally having a substantially flat portion insertable into said shell and provided at an end thereof with substantially symmetrical lugs engageable with said rolls, wherein substantially coaxial slots extending substantially transversely with respect to a central axis of said shell, are provided in said plates, said slots adapted to receive said rolls, substantially coaxial slots which extend substantially in line with said central axis of said shell, are also provided in said plates, said member for stopping said rolls in the latched position of the buckle being in the form of a wedge rigidly connected through said axially-extending slots with said push button and having a tapered end facing said rolls, said member for stopping said rolls in the unlatched position of the buckle, having the form of plate-like pushing elements situated at sides of said plates forming said shell and for engagement with an end face of said portion of said prong insertable into said shell and with said rolls, and wherein said prong additionally comprises a shaped recess open at the end face of said insertable portion, said recess defining said lugs of said insertable portion of said prong, such that said lugs face one another.

2. The buckle of claim 1, additionally comprising a rivet joining front ends of said plates of said shell together, said shaped recess of said prong having an indentation adapted to embrace an inner portion of said rivet in the latched position of the buckle.

3. The buckle of claim 1, wherein a distance between said lugs of said insertable portion of said prong is substantially equal to a sum of diameters of said rolls, and a width of an inner portion of said shaped recess of said prong is substantially equal to a sum of the diameters of said rolls and a width of said wedge.

4. The buckle of claim 1, wherein said transversely-extending slots in said plates are substantially arcuate.

5. The buckle of claim 1, wherein the housing of the buckle comprises ribs substantially longitudinally extending along an interior thereof, confining said shell on two sides with respect to a width of said insertable portion of said prong.

6. The buckle of claim 1, wherein said recess comprises an interior portion being wider than the open portion thereof at the end face of said insertable portion.

7. The buckle of claim 2, wherein said inner portion of said rivet comprises a radius of curvature substantially equal to a radius of curvature of said indentation.

8. The buckle of claim 1, wherein said transversely-extending slots are rounded at ends thereof with a radius of curvature substantially equal to a radius of said rolls.

9. The buckle of claim 6, wherein said lugs mate with said insertable portion of said prongs at said wide portion of said recess, through a curvature having a radius substantially equal to a radius of said rolls.

10. The buckle of claim 5, wherein said transversely-extending slots comprise a radius of curvature about 3 to 7 times a diameter of said rolls.

11. The buckle of claim 10, wherein said transversely-extending slots each have a width slightly greater than a diameter of said rolls.

12. The buckle of claim 1, additionally comprising a second rivet clamping said plates of said shell together, said second rivet being situated on a side of said rolls opposite said first rivet.

13. The buckle of claim 3, wherein the width of said wedge is slightly less than the distance between said lugs.

14. The buckle of claim 3, wherein a distance between inner side edges of said plate-like pushing elements is substantially equal to the sum of the diameters of said rolls.

15. The buckle of claim 1, additionally comprising a pair of springs, each spring connected at one end thereof with a respective plate-like pushing element, and at the opposite end thereof with the housing, said springs biasing said plate-like members towards said rolls, and a third spring engaged at one end thereof with said push-button and at an opposite end thereof with the housing, said third spring biasing said push-button in a direction out of the housing.

16. The buckle of claim 15, wherein said push-button and said housing comprise respective substantially longitudinally-extending ribs for confining said third spring therebetween, said button comprises a cross-rib upon which the end of said third spring bears, and the housing comprises a shelf upon which the opposite end of the said third spring bears.

* * * * *